US006053353A

United States Patent [19]

Helms

[11] Patent Number: 6,053,353

[45] Date of Patent: Apr. 25, 2000

[54] COMPOSITE CONTAINER CLOSURE

[75] Inventor: Charles R Helms, Earleville, Md.

[73] Assignee: Double "H" Plastics, Inc., Warminster, Pa.

[21] Appl. No.: 09/253,305

[22] Filed: Feb. 19, 1999

[51] Int. Cl.[7] ..... B65D 43/08

[52] U.S. Cl. ..... 220/796; 206/508; 220/799; 220/611; 229/5.5; 229/125.19; 264/252; 264/268; 264/261; 264/263

[58] Field of Search ..... 220/796, 799, 220/FOR 105, 611, 618; 215/DIG. 4; 229/5.5, 4.5, 125.19; 206/508; 264/252, 261, 263, 267, 268

[56] References Cited

U.S. PATENT DOCUMENTS

| | | | |
|---|---|---|---|
| 3,360,152 | 12/1967 | Leers | 220/799 X |
| 3,412,889 | 11/1968 | Eicholtz et al. . | |
| 3,458,619 | 7/1969 | Proshaska | 264/263 |
| 3,705,831 | 12/1972 | Sayre et al. | 264/263 |
| 3,910,483 | 10/1975 | Ritter | 229/125.19 |
| 3,956,550 | 5/1976 | Sutch . | |
| 4,038,359 | 7/1977 | Pendleton | 264/268 X |
| 4,228,912 | 10/1980 | Harris et al. | 264/263 X |
| 4,238,047 | 12/1980 | Helms et al. . | |
| 4,252,248 | 2/1981 | Obrist et al. . | |
| 4,301,941 | 11/1981 | Kraft . | |
| 4,438,864 | 3/1984 | Helms | 229/5.5 X |
| 4,585,145 | 4/1986 | Pitroda | 220/799 X |
| 5,050,763 | 9/1991 | Christensson . | |
| 5,197,935 | 3/1993 | Schweri | 264/263 X |
| 5,288,448 | 2/1994 | Andersson | 264/268 X |

*Primary Examiner*—Allan N. Shoap
*Assistant Examiner*—Robin A. Hylton
*Attorney, Agent, or Firm*—Synnestvedt & Lechner LLP

[57] ABSTRACT

A container closure including a rim formed by injection molding, a skirt depending from rim for engagement with a container body, a top panel formed from a blank of sheet material, such as paperboard, a side panel formed from the same blank as the top panel, the side panel positioned vertically to the top panel, the top panel located and bonded to the rim, the rim bonded to an interior side of the side panel, with a portion of the side panel bonded to an exterior portion of rim.

9 Claims, 3 Drawing Sheets

FIG.5
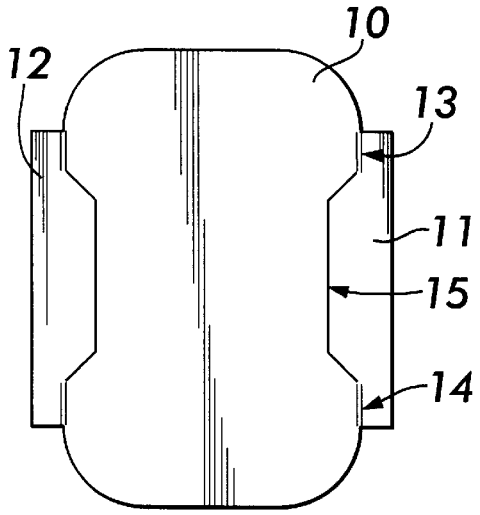
FIG.6
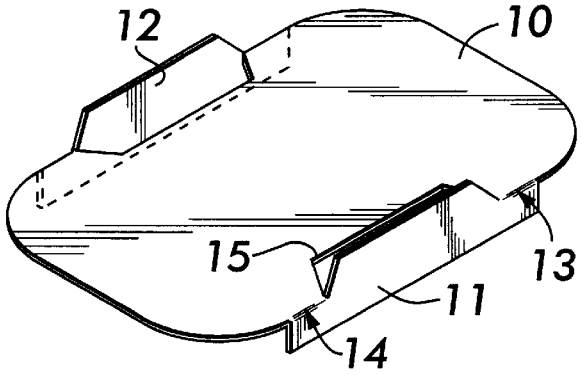
FIG.7
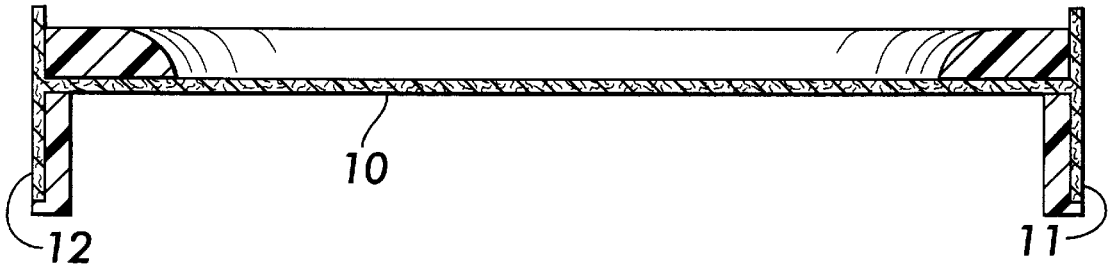
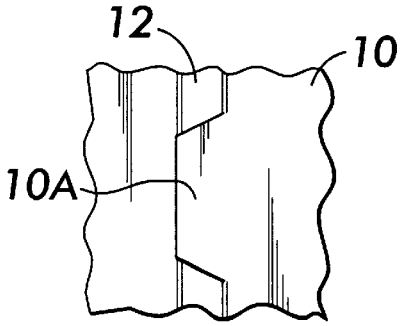
FIG.8
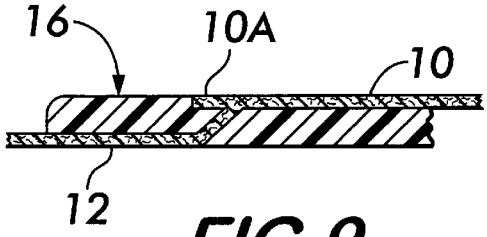
FIG.9
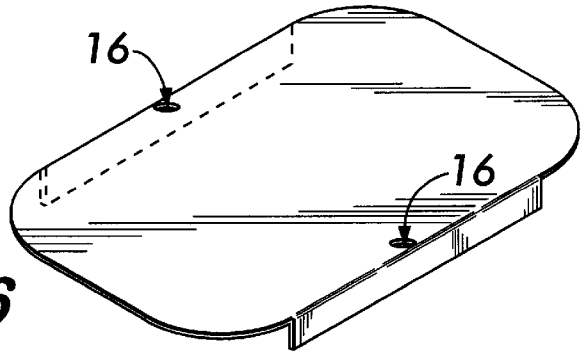
FIG.16

FIG.10
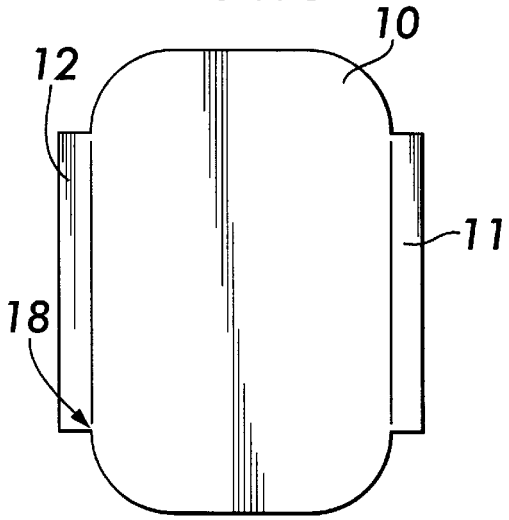
FIG.11
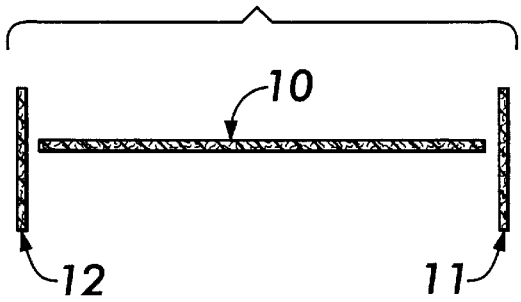
FIG.12
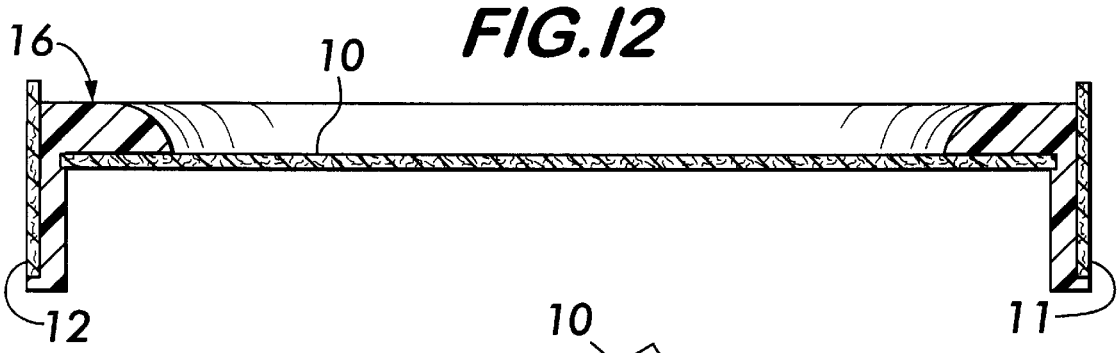
FIG.14
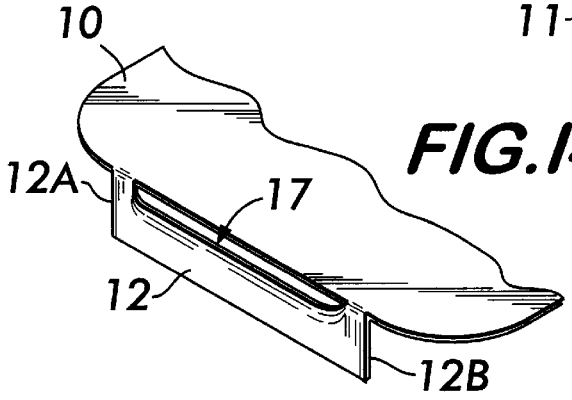
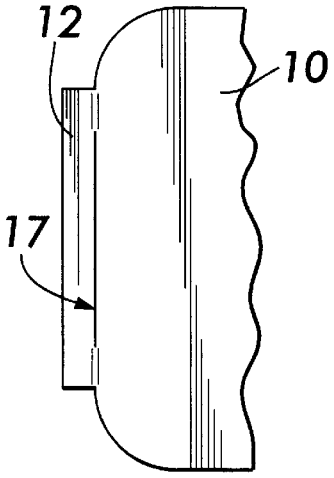
FIG.13
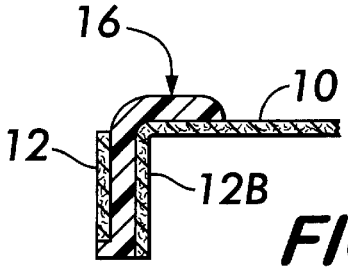
FIG.15

COMPOSITE CONTAINER CLOSURE

BACKGROUND OF THE INVENTION

1. Field of the Invention

This invention relates generally to closure arrangements, and more particularly it relates to a closure arrangement including a composite lid composed of a molded plastic rim and a central panel of paperboard or similar material which includes an extension of the central panel which is positioned outside of the plastic rim providing a surface which may be printed upon.

2. Background Art

A search of the records of the U.S. Patent Office directed at the subject matter of this application discovered the following U.S. Pat. Nos.:

3,412,889
3,956,550
4,238,047
4,252,248
4,301,941
5,050,763

A review of the above patents determined that none of the patents disclosed or claimed a closure arrangement with a composite lid as taught within the present application.

The present invention is drawn to a lid or cover for a container of the type where it snaps over an upper flange or edge of the container. Covers of the type described herein typically utilize injection molding to provide the necessary plastic rims or edges for the closure. However, it is common practice to employ a sheet of printed material, such as paperboard, for the cover top panel, molding a plastic resin bonded to the panel compatible with the panel material to form the rim or engagement means.

In most cases, it is common practice to extend wings or flaps from the cover panel that extend down the inside of the rim to control warping when the molded plastic that forms the rim shrinks.

Typically, it is common practice to inject a plastic resin against the top surface of paperboard, or similar material, panel so that the side of the mold has more available space for any injection nozzle apparatus. It has been found that the resultant molded plastic rim can be utilized to form a stacking rim for stacking the lids prior to joining the lids to the container. Such stacking rings are easily molded when the plastic resin overlays the top of the insert panel.

In such applications the wings or flaps are attached to the panel in the usual manner, whereby the molded plastic folds over the top surface of the flap resulting in the flap being contained from the outside, thus only being visible from the underside.

It has been found highly desirable by many users of containers employing such closures to provide printed information, such as advertising material or dating information, etc., on the outside closure skirt. However, providing such information on the plastic used in typical closure manufacture is usually quite unsatisfactory. It has been found that the plastic rim, or engagement means, provides substantial advantage over containers that are all of paperboard having an outside paperboard edge which can be printed upon. The advantages include the fact that the plastic closures are more durable, and can have a more positive locking means. Therefore, it is an object of the present invention to provide the closure member of the type described including means whereby a paper printable surface can be provided on the exterior of the rim. Other objects and advantages of the present invention become apparent from the following detailed description taken in conjunction with the accompanying drawings, wherein are set forth by way of illustration and example certain embodiments of the present invention.

SUMMARY OF THE INVENTION

The present invention is directed to improvements in the production of composite container closures which comprise a flexible blank, such as paperboard or other material which is easily printed upon with a molded rim defining a connecting portion which is molded in contact with the blank. In particular, the invention relates to such products in which a blank panel is surrounded by a peripheral element, such as a rim or connecting device. Such products typically include lids or similar covers. In the usual arrangement, the top blank or panel is clamped in a planar position in a mold cavity which includes a peripheral channel for receiving synthetic injection molded thermal plastic material to connect the rim around the panel.

According to a particular aspect of the present invention, there is provided a composite lid, including a blank of sheet material and a peripheral molding wherein a marginal portion of the blank is displaced out of the general lateral plane of the central panel thereof and the peripheral molding includes a portion of the outer marginal portion bonded to a portion of the marginal portion of the blank.

Because many marketers of products sold in containers with lids desire to have printing on the skirt of the lid, there is a need to achieve a method for injecting the plastic to the top surface of one portion of the inserted material, namely the central blank, and to the back surfaces of the other marginal portions, or a portion of the inserted material.

This method is achieved when the inserted material is one integral part with foldable scores or where the inserted material is cut into multiple elements whereby the side skirt insert is not contiguous with the top insert. Accordingly, as described herein it will be seen that the main panel can have a number of flaps or wings folded from it and the folding does not necessarily require a change in plane. By virtue of the techniques described herein, because of the desirability of having a printed surface on the outside of the rim or edge, it is desired to inject the surface of an insert and by means of a partial cut or cut score, inject the molded plastic down the middle of the substrate or panel leaving both surfaces on the surface of the composite molding.

Thus, a dual advantage is provided by the present invention. Because of plastic shrinkage, the wings or extended portions of the upper panel control shrinkage and keep the lid from distorting. At the same time, having the wing or peripheral panel portion extended outside of the plastic rim, the ability is provided therein to have a printed surface on the lid skirt.

Accordingly, it is an object of the present invention to provide a composite article or lid, including a blank of sheet material and a peripheral molding, wherein a marginal portion of the blank is displaced out of the general plane of the central panel, and the peripheral molding includes the marginal portion of the blank bonded to a portion of the rim on an exterior surface, to control longitudinal shrinkage and provide a printed surface on such marginal section. It can be readily seen the object of the invention is to construct the fold line on the central panel or paper insert in such a manner that the insert when folded in a mold provides the top surface of the main panel and the bottom surface of any peripheral panel to the flowing plastic. A review of what has been done in the past shows that the plastic entering the mold contacts the top surface and the inside of any dependent side panels. While in the present invention, the plastic contacts the top panel and the inside of any dependent side panel.

This arrangement is accomplished by the placement of an offset cut in the fold line that occurs between the upper or insert panel and the dependent side panels. A number of different methods for providing access to the placement of the plastic so that it has contact to the top surface of the panel and to the inside surfaces of the dependent side panels or wings can be achieved by means of cuts or partial cuts between the two panels or also simple openings for plastic injection points at the juncture point of the planar top panel and the dependent side panels.

While it might seem obvious from the foregoing that it would be possible to achieve the same ends by molding the lid from the other side, it has been found that this is technically very difficult because of the lack of room and available space. This arrangement lacks the additional advantage found in the described method in that the plastic so molded would not form a stacking ledge on the top which would facilitate the stacking of the lids during cooling and packing of the lids prior to their joinder to containers.

It has been found and will be shown herein that while a number of variations on the present objects can be met by providing slightly different folding arrangements between the upper or planar panel and the side or dependent panels. Such arrangements include different cut shapes for the dependent panels, as well as the provision of partial or completely separated sections between the upper panel and dependent side panels by utilization of a core cutout between the top planar panel and dependent panels. All of which, as will be seen herein, facilitate the flowing of the thermoplastic which, during injection molding, is in contact with the top surface of the planar panel and is an inside surface of the dependent panel which can be readily printed thereupon.

Accordingly, from the foregoing, it will be obvious that the closure design of the present invention provides substantial advantages over the prior art and that it provides in addition to shrinkage or wrinkling stabilization, exterior as well as top printed surfaces, and easily facilitates the production of the closure of the present invention by means of employing injection molding of thermal plastic material.

These and other objects of the present invention will be apparent from the examination of the following description and drawings.

BRIEF DESCRIPTION OF THE DRAWINGS

A better understanding of the present invention may be had from consideration of the following detailed description taken in conjunction with the following drawings wherein similar numbers denote similar elements:

FIG. 1 shows a lateral panel with dependent side panels as utilized in the prior art.

FIG. 2 is a perspective view of an upper panel with dependent side panels in the folded position as utilized in the prior art.

FIG. 3 is a sectional view showing a molded plastic skirt and a main or lateral panel with dependent or peripheral side panels as utilized in the prior art.

FIG. 4 shows a partial sectional view of a lid or closure in accordance with the prior art wherein the thermoplastic is shown with its point of insertion.

FIG. 5 is a top plan view of a top panel with dependent side panels arranged for utilization in accordance with the teachings of the present invention.

FIG. 6 is a perspective view of a top panel with dependent side panels folded as utilized in the present invention.

FIG. 7 is a sectional view in accordance with the present invention showing plastic as injected in accordance with the teachings of the present invention.

FIG. 8 is a partial top view of another approach to providing a top panel and dependent side panels in accordance with the present invention.

FIG. 9 is a partial sectional view of the top panel and dependent side panels in the horizontal position with the thermoplastic injection material shown in position prior to completion.

FIG. 10 is a top plan view of yet another approach to solving the particular problem wherein the paperboard insert includes joinder corners between the side panels and the top panel.

FIG. 11 is a sectional view that shows the panels with the dependent side panels sheared from the top panel.

FIG. 12 is a sectional view showing the top planar panel and the two dependent side panels and the thermoplastic injection molding providing a top rim and backing inside of the side panels as utilized in connection with the embodiment of FIGS. 10 and 11.

FIG. 13 is a partial top view of a center planar panel and dependent side panels showing a cut extending between the top panel and the peripheral side panel.

FIG. 14 is a perspective view of the top panel and a dependent side panel showing how the dependent side panel may be folded around a curved core to provide an opening whereby the thermoplastic material may be injected in the mold.

FIG. 15 is a sectional view showing how the thermoplastic is injected between the side panel and upper panel.

FIG. 16 is a perspective view showing the upper panel and dependent side panel with thermoplastic material injection molding points.

DETAILED DESCRIPTION OF THE PREFERRED EMBODIMENTS

Figure 1:
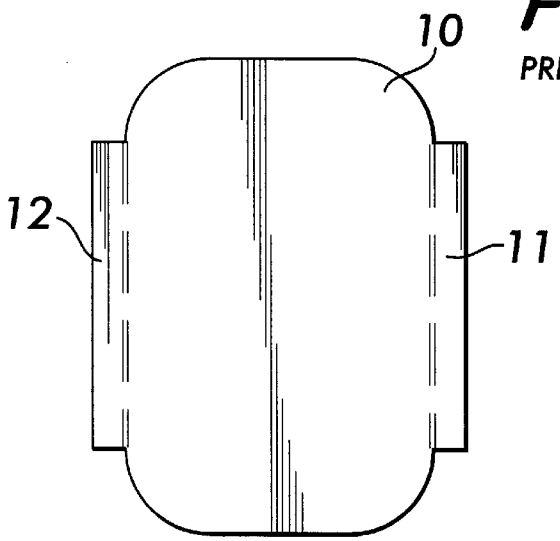
FIG.1 PRIOR ART
FIGS. 1, 2, 3, and 4 are figures denoting the prior art.
Figure 2:
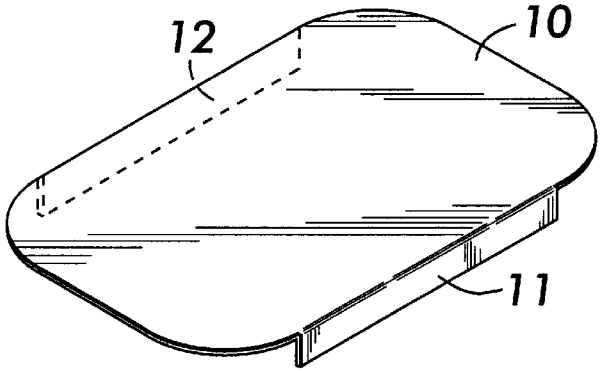
FIG.2 PRIOR ART
Figure 3:
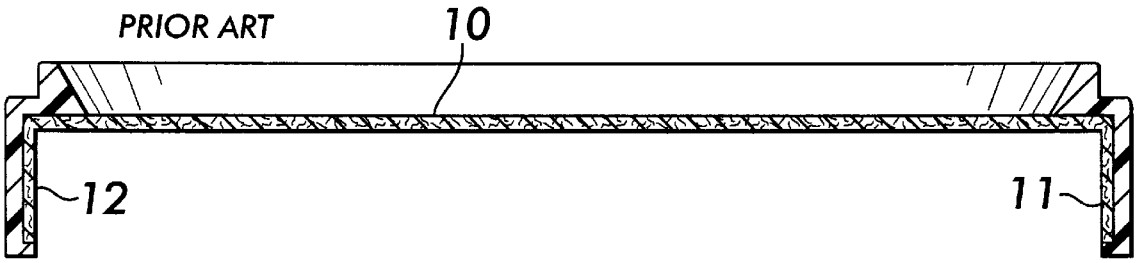
FIG.3 PRIOR ART
Figure 4:
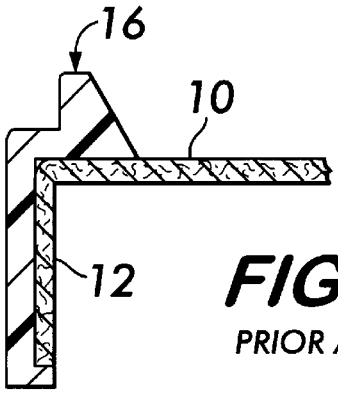
FIG.4 PRIOR ART

Referring now to the drawings for a better understanding of the present invention, it will be seen by referring first to FIGS. 1, 2, 3, and 4, representing the prior art, showing a lid as utilized with thermoplastic injection molding for the rim and a paperboard or flat panel with dependent side panels is arranged in accordance with the teachings of the prior art. FIG. 1 is a plan view of the paperboard top panel 10 with peripheral or dependent side panels 11 and 12. In normal operation, the main or top planar panel 10 carries a printed surface. The dependent or side panels are folded down as seen in FIG. 2. After this, with injection molding, a molded edge or skirt has been applied to the lid as seen in the sectional view shown in FIG. 3, wherein the plastic lays upon the outer edges of the main panel 10 and on the outsides of dependent or side panels 11 and 12. While this arrangement is effective to control shrinkage and keeps the lid from distorting, the principal limitation of this type of closure or lid is its inability to show a printed surface on the skirt of the lid. The injection point 16 seen in FIG. 4 forms a ridge, useful for stacking of lids before placement on containers.

Referring now to FIG. 5, an upper or plan view of the paperboard portion of the lid in accordance with the teachings of the present invention is shown. The side panels are folded, for example, utilizing dependent or side panel 11 is folded along the lines 13 and 14 and with an actual cut being made as shown at cut 15 where the cut is slightly inserted into the main part of panel 10. The manner in which the side panels are dependent in the folded position is seen in FIG. 6.

The net result of this folding arrangement is seen after injection takes place at points such as 16, as seen in FIG. 7, wherein the flow of the thermoplastic occurs around the edge of top panel 10 and then descends in a vertical downward position to the inside of panels 11 and 12.

A number of other variations will be shown and discussed hereinafter, but all follow essentially this same approach wherein application of plastic by injection molding causes the plastic to flow around the top edge of a planar or horizontal top panel 10 and then flows inside of vertical, dependent or peripheral side panels 11 and 12.

Referring now to FIGS. 8 and 9, an alternate form of the present invention is shown wherein the top panel 10 is provided with a projection extension 10A which will overlay the injection molded plastic which is initially injected at point 16 which has been folded in a downward direction to provide the necessary folded rim. Much of the downward projecting panel 12 will be behind the plastic with peripheral portion 10A extending on the outside of the molded rim.

Another approach, described in FIG. 10, provides initially with the top horizontal panel 10 connected at corner nicks 18 to dependent side panels 11 and 12. The paperboard panel consisting of 10, 11 and 12 is then folded with the dependent side panels placed in a downward direction and the nicks sheared as in FIG. 11 so that when thermoplastic is injection molded, as shown in FIG. 12, the plastic rim will be formed to secure the upper portion of planar panel 10 and then lie behind dependent panels 11 and 12, as seen in FIG. 12.

FIGS. 13, 14, and 15 show yet another variation wherein a cut 17 is provided partially through between the dependent side panel, such as 12, and the horizontal planar panel 10 as defined by 17 in FIG. 13. Side panel 12 has oppositely disposed end portions 12A and 12B which remain attached to top panel 10. Side panel 11 is similarly configured. The paperboard is then inserted around a curved core in the mold providing an opening 17 which is stretched out as seen in FIG. 14, after which injection of the thermoplastic occurs at point 16, as shown in FIG. 15, and a rim is formed adjacent the outside edge of top panel 10 and behind the dependent side panels, such as 11 (not shown) or 12, but in front of end portions 12A and 12B as seen in FIG. 15.

It should be pointed out that while in most of the instances described above, the peripheral, or side panels, are on the outside of the thermoplastic which has been added by injection molding, providing for multiple printed surfaces on the exterior of the rim. However, in some instances it may be desirable to have only one side outside and the other inside, since printing or other information may be limited to one side only of the completed lid.

Most of the illustrations shown in the figures of the present application are essentially rectangular with rounded corners of a quasi-elliptical nature, with a pair of dependent or side panels shown. It is quite possible to apply similar techniques to round container lids, applying a substantial additional number or plurality of side panels to effectively provide coverage of the entire circumference of the lid.

For example, a round cover applying the techniques set forth in FIGS. 4, 5, 6, and 7, it is quite conceivable within the teachings of the present application. Likewise, a round lid embodiment employing the teachings of FIGS. 10, 11, and 12 is also possible, however, the nicks as shown in FIG. 10 are not completely sheared through as shown in FIG. 11. The resulting teachings as applied are quite effective in the provision of round lids with one more exterior surfaces that provide for printing or lettering thereon.

While only several embodiments of the present invention have been shown, it will be obvious to those skilled in the art that numerous modifications may be made without departing from the spirit of the present invention, which shall be limited only by the scope of the claims appended hereto.

What is claimed is:

1. A composite container closure member comprising:

a continuous rim formed from an injection molded thermoplastic material;

a skirt depending from said rim for engagement with the wall of a container body;

a central top panel formed from a blank of generally flexible sheet material;

at least one peripheral dependent side panel formed from the same blank as said central top panel, initially joined to said central top panel;

said dependent side panel positioned vertically in a plane perpendicular to said central top panel;

said central panel disposed within said rim and bonded thereto by the material of said rim;

said rim material further bonded to an interior side of said dependent side panel;

whereby at least a portion of said side panel is bonded to an exterior portion of said rim material.

2. A composite container closure member as claimed in claim 1 wherein said blank further includes a cut partially separating said side panel from said top panel.

3. A composite container closure member as claimed in claim 2 wherein said partially separated side panel is further completely separated from said top panel.

4. A composite container closure member as claimed in claim 1 wherein said side panel is folded at a junction between said top and said side panel to position said side panel in a plane perpendicular to said top panel.

5. A composite container closure member as claimed in claim 1 wherein only a portion of said side panel extends over and is bonded to said rim.

6. A composite container closure member as claimed in claim 1 wherein said thermoplastic material is injected at a location at the joinder of said side panel to said top panel .

7. A composite container closure member as claimed in claim 1 wherein said plastic at said point of injection forms a bead adapted to facilitate stacking of said closure member.

8. A composite container closure member as claimed in claim 1 wherein said side panel is deformed prior to injection of said thermoplastic material to facilitate the flow of said material behind said side panel.

9. A composite container closure member as claimed in claim 1 wherein the flexible sheet material is paperboard.

* * * * *